US005797069A

United States Patent [19]

Kimura et al.

[11] Patent Number: 5,797,069

[45] Date of Patent: Aug. 18, 1998

[54] DEVELOPING DEVICE FOR IMAGE FORMING APPARATUS

[75] Inventors: Noriyuki Kimura, Kawasaki; Hiroyuki Matsushiro, Yokohama; Tsuyoshi Deki, Koshigaya; Takeshi Motohashi, Kawasaki, all of Japan

[73] Assignee: Ricoh Company, Ltd., Tokyo, Japan

[21] Appl. No.: 732,983

[22] Filed: Oct. 16, 1996

[30] Foreign Application Priority Data

Oct. 16, 1995 [JP] Japan ..... 7-293449

[51] Int. Cl.[6] ..... G03G 15/01

[52] U.S. Cl. ..... 399/113; 399/112; 399/223; 399/224; 399/227

[58] Field of Search ..... 399/111–113, 119, 399/125, 223–224, 226, 227

[56] References Cited

U.S. PATENT DOCUMENTS

| | | | |
|---|---|---|---|
| 3,987,756 | 10/1976 | Katayama et al. | 399/227 |
| 4,792,825 | 12/1988 | Saito et al. | 399/227 |
| 4,821,075 | 4/1989 | Saito et al. | 399/27 |
| 4,922,301 | 5/1990 | Katoh et al. | 399/227 |
| 4,933,727 | 6/1990 | Mizuma et al. | 399/298 |
| 5,160,969 | 11/1992 | Mizuma et al. | 399/223 |
| 5,198,866 | 3/1993 | Kimura et al. | 399/222 |
| 5,258,819 | 11/1993 | Kimura et al. | 399/119 |
| 5,325,151 | 6/1994 | Kimura et al. | 399/227 |
| 5,512,984 | 4/1996 | Kimura et al. | 399/228 |
| 5,552,877 | 9/1996 | Ishikawa et al. | 399/227 |
| 5,587,769 | 12/1996 | Sawada et al. | 399/117 |
| 5,600,431 | 2/1997 | Takeda et al. | 399/226 |
| 5,612,769 | 3/1997 | Sugihara et al. | 399/119 |
| 5,617,188 | 4/1997 | Inomata | 399/119 X |
| 5,671,470 | 9/1997 | Maruta et al. | 399/227 X |

FOREIGN PATENT DOCUMENTS 4-029166 1/1992 Japan .

OTHER PUBLICATIONS

Patent Abstracts of Japan, Abstract of 60–260968,Murayama Y., Dec. 24, 1985.

Patent Abstracts of Japan, Abstract of 60–221778, Yamazaki F. et al., Nov. 6, 1985.

Patent Abstracts of Japan, Abstract of 63–078170,Saito T., Apr. 8, 1988.

*Primary Examiner*—Matthew S. Smith

*Attorney, Agent, or Firm*—Oblon, Spivak, McClelland, Maier & Neustadt, P.C.

[57] ABSTRACT

A color printer including a photoconductive belt, a black developing unit which is located adjacent the photoconductive belt and a revolving type developing unit which is located adjacent the photoconductive belt and has a developing position on the photoconductive belt which is different from that of the black developing unit. The revolving type developing unit has a yellow developing device, a magenta developing device and a cyan developing device, each including a detachable toner cartridge by which yellow toner, magenta toner and cyan toner is replenished. The black developing unit is replaceable independent of the revolving type developing unit by being removably mounted on a removable frame on which the revolving type developing unit is mounted. Both developing units are removable from the color printer as a body by removal of the removable frame from the color printer.

14 Claims, 12 Drawing Sheets

DEVELOPING DEVICE FOR IMAGE FORMING APPARATUS

BACKGROUND OF THE INVENTION

1. Field of the Invention

The present invention relates to a developing device for an image forming apparatus such as copier, a printer, a facsimile machine or similar electrophotographic image forming apparatus. More particularly, the invention is concerned with a color image forming apparatus which has a plurality of developing devices.

2. Discussion of Background

A conventional developing device for a color image forming apparatus has a revolving type developing device, in which a plurality of developing devices each having a different mono-color toner are installed and disposed adjacent to a photoconductive member to develop a latent image formed thereon.

In such a device, it is necessary for an operator to replenish the developing device with toner. In order to examine and to adjust the developing device, it is necessary to remove the developing device from the color image forming apparatus. Further, it is necessary to exchange the developing device for a new one when the developing device reaches the end of its useful life.

In the color image forming apparatus, the ratio of the number of black and white image formations to color image formations is from nine to one, to seven to three. Since the frequency of use of the black developing device is higher than that of the other color developing devices, the maintenance cycle of the black developing device is shorter than that of the other color developing devices. Therefore, it is essential to be able to easily replenish toner of the black developing device. Further, the black developing device has to be removed and installed easily.

Japanese Laid-open Patent No. 60-233668 and Japanese Laid-Open Patent No. 61-97674 disclose a color image forming apparatus in which stationary toner cartridges which are connected with a revolving type developing devices are positioned in the apparatus. Each toner cartridge is connected with its developing unit positioned in the revolving type developing device by an elastic tube. A toner transporting screw positioned in the tube rotates, and then toner in the toner cartridge is transported to the developing device.

In such devices, it is necessary to provide connecting parts at joints in order to prevent the tube and the screw from twisting when the revolving type developing device rotates. Further, it is necessary to provide shutters or seals at the joints in order to prevent toner from leaking at the joints. As a result, the structure of the revolving type developing device becomes complex, and its cost is increased.

Further, the revolving type developing devices of the related arts leave open the question of maintenance of the black developing device.

Japanese Patent Publication No. 4-23782, Japanese Patent Publication No. 4-38362, Japanese Laid-Open Patent No. 6378170 and Japanese Laid-Open Patent No. 4-29166 disclose a revolving type developing device in which a plurality of developing units are positioned is removed from a color image forming apparatus in a body. In such devices, when toner in one developing unit becomes empty, the revolving type developing device itself has to be exchanged. Further, these revolving type developing devices leave open the question of maintenance of the black developing device.

Japanese Laid-Open Patent No. 60-208779, Japanese Laid-Open Patent No. 60-214377, Japanese Laid-Open Patent No. 61-73163 and Japanese Laid-Open Patent No. 61-103175 disclose a revolving type developing apparatus in which each developing unit positioned in the revolving type developing device is independently removable from the device. Especially, the Japanese Laid-open Patent No. 61-103175 discloses toner cartridges which are installed in and removable from the revolving type developing device. However, this revolving type developing device also leaves open the question of maintenance of the black developing device.

Japanese Patent Publication No. 59-26954, Japanese Laid-Open Patent No. 60-233669, Japanese Laid-Open Patent No. 62-85266, Japanese Laid-Open Patent No. 62-102261, Japanese Laid-Open Patent No. 63-26847 and Japanese Laid-open Patent No. 63-41871 disclose a color image forming apparatus in which a black developing device and a revolving type developing device having different developing positions on a photoconductive drum, are provided. Especially, the Japanese Laid-Open Patent No. 63-41871 and the Japanese Laid-Open Patent No. 62-102261 disclose developing devices in which the capacity of the toner container of the black developing device is larger than that of developing units in the revolving type developing device in order to extend the maintenance cycle of the black developing device. However, these related references do not disclose methods or structure for replenishing new toner to the black developing device and for removing and installing the black developing device.

SUMMARY OF THE INVENTION

Accordingly, it is an object of the present invention to provide a color image forming apparatus that satisfies the aforementioned requirements.

It is another object of this invention to provide a novel color image forming apparatus that can facilitate maintenance of the black developing device and color developing devices.

These and other objects are achieved according to the present invention by providing a novel color image forming apparatus including a image bearing device for bearing an electrostatic latent image thereon, a first developing device which is formed as a replaceable single developing unit for developing the electrostatic latent image and a second developing device for developing the electrostatic latent image, including a means for supplying toner from outside of the second developing device.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
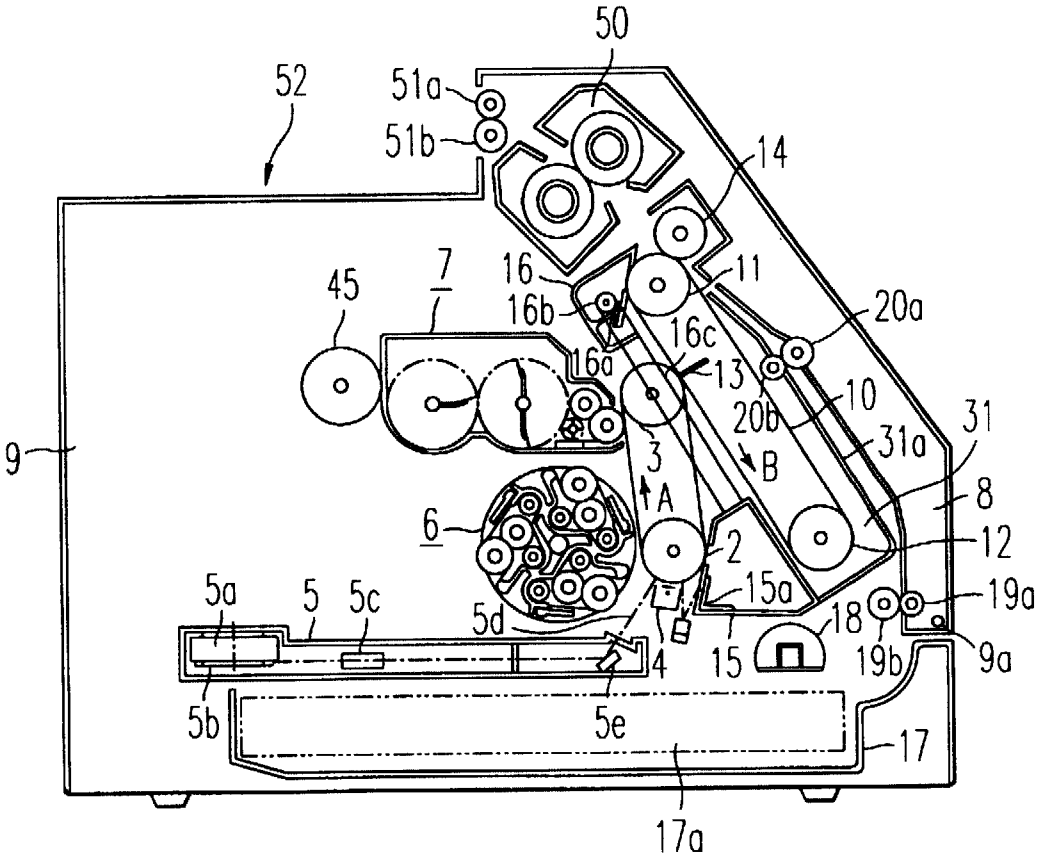
FIG. 1 is a front sectional view of a color image forming apparatus of the present invention.

Referring now to the drawings, wherein like reference numerals designate identical or corresponding parts throughout the several views, and more particularly to FIG. 1 thereof, a color printer embodying the present invention is shown and includes a photoconductive belt 1 which is supported by a driving roller 2 and a roller 3. The photoconductive belt 1 rotates in a direction indicated by an arrow A. The printer has the following elements disposed around the belt: a charger 4 which charges the photoconductive belt 1, a laser optics unit 5 which forms a latent image on the photoconductive belt 1, a revolving type developing device 6 which has an yellow developing unit, a magenta developing unit and a cyan developing unit, a black developing device 7, an intermediate transfer belt 10 which is supported by rollers 11 and 12 for rotating in a direction indicated by an arrow B, and a cleaned toner container 15 which has a cleaning blade 15*a* for cleaning residual toner on the photoconductive belt 1.

The intermediate transfer belt 10 is held in contact with the photoconductive belt 1 at the driving roller 3. An electric conductive bias brush 13 is held in contact with the back side of the intermediate transfer belt 10. A cleaning device 16 is disposed around the intermediate transfer belt 10. The cleaning device 16 has a cleaning blade 16*a* which is at a distance from the transfer belt 10 during the image forming period of time and is held in contact with the transfer belt 10 after a toner image on the transfer belt 10 is transferred to a sheet of paper, copysheet 17*a*.

A paper cassette 17 is disposed at the bottom of the printer. Copysheet 17*a* in the paper cassette 17 is fed by a paper feed roller 18, and then transported to a nip between the transfer belt 10 and the transfer roller 14 by a pair of paper feed rollers 19*a* and 19*b* and a pair of registration rollers 20*a* and 20*b*.

In operation, the photoconductive belt 1 is uniformly charged by the charger 4, and then the charged surface of the photoconductive belt 1 is exposed by the laser optics unit 5 to form an electrostatic latent image on the photoconductive belt 1. Full color image information to be formed as a color image is separated into yellow image information, magenta image information, cyan image information and black image information. A semiconductor laser (not shown) emits a laser beam 5*d* corresponding the yellow image information. The laser beam 5*d* is steered by a polygonal mirror 5*b*, rotated by a polygonal motor 5*a* and is projected onto the photoconductive belt 1 via an f–θ lens 5*c* and a reflecting mirror 5*e*. The yellow electrostatic latent image is developed by the yellow developing unit, and then a yellow toner image on the photoconductive belt 1 is transferred to the intermediate transfer belt 10 by electric bias voltage applied from the electric conductive bias brush 13. The same operations are executed for magenta, cyan and black development sequences. The yellow, magenta and cyan developing operations are executed by the revolving type developing device 6, and the black image formation is executed by the black developing device 7. The yellow, the magenta, the cyan and the black toner images are transferred to the copysheet 17*a* at one time by a electric bias voltage applied from the transfer roller 14. After the transfer operation, a full color toner image on the copysheet 17*a* is fixed by a fixing device 50. The copysheet 17*a* is then discharged on a paper tray 52 by a pair of paper discharging rollers 51*a* and 51*b*.

Residual toner on the intermediate transfer belt 10 is cleaned by the cleaning blade 16*a*. The residual toner is then transported to the cleaned toner container 15 via an auger 16*b* and a toner transporting device 16*c*. The cleaned toner container 15 is replaceable with a new one.

When an inputted image is a black color image, after the electrostatic latent image is formed on the photoconductive belt 1, the black developing device 7 is operated to form a black toner image on the photoconductive belt 1. The black toner image is transferred to the intermediate transfer belt 10, and then it is transferred from the intermediate transfer belt 10 to the copysheet. Other image forming processes are the same as the full color image forming process.

The photoconductive belt 1, the driving roller 2, the intermediate transfer belt 10, the cleaning device 16 and the registration rollers 20*a*, 20*b* are integrated as a process cartridge 31 which is replaced when one of the process devices reaches the end of its useful lifetime. The cleaned toner container 15 is also mounted on the process cartridge 31. However, the cleaned toner container 15 is separate from the process cartridge 31, and when full of toner, can be replaced separately from the process cartridge 31. The registration roller 20*b* is mounted on an outer surface 31*a* of the process cartridge and the outer surface 31*a* works as a paper guide plate.

Figure 2:
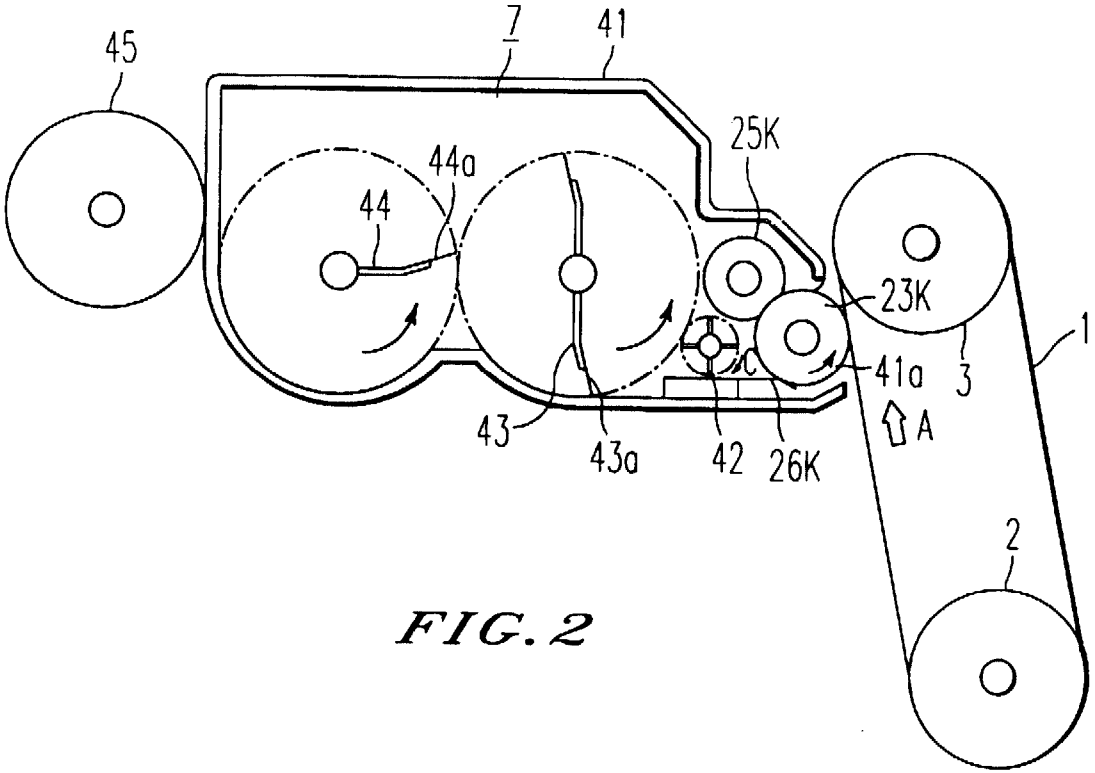
FIG. 2 is a front sectional view of a photoconductive belt and a black developing device of the present invention.

FIG. 2 shows the black developing device 7 of the present invention. The black developing device 7 includes a toner container 41 which contains black toner and a developing roller 23K having a surface which is projected from an opening 412. The black developing device 7 is replaced when the black toner becomes empty. A toner supply roller 25K made of polyurethane foam is rotatably supported in the toner container 41 to supply the toner to the developing roller 23K. A longitudinal direction of the toner supply roller 25K is parallel to that of the developing roller 23K, and the toner supply roller 25K is in pressure contact with the developing roller 23K to form a nip. The surface of the toner supply roller 25K moves in the direction of the surface of the developing roller 23K at the nip. Toner on the toner supply roller 25K is supplied to the developing roller 23K at the nip.

A blade 26K of an elastic thin plate of stainless is provided in the toner container 41. A free end of the blade 26K is held in pressure contact with the surface of the developing roller 23K to regulate the thickness of the toner on the surface of the developing roller 23K. A bladed agitating paddle 42 is rotatably supported in the toner container 41, and rotates in a direction indicated by an arrow C. The agitating paddle 42 agitates toner near the toner supply roller 25K to prevent accumulation of toner which is removed from the surface of the toner supply roller by the blade 26K. Further, the agitating paddle 42 supplies toner to the toner supply roller 25K.

A first agitator 43 and a second agitator 44 are also provided in the toner container 41. The second agitator 44 agitates toner in the toner container 41 and transports toner to the first agitator 43. The first agitator 43 agitates toner in the toner container 41 and transports toner to the toner supply roller 25K. Elastic film sheets 43*a* and 44*a* are fixed on free ends of each of agitators 43 and 44, and have ends held in contact with the inner bottom surface of the toner container 44. Since the free ends of the elastic film sheets 43*a* and 44*a* contact bottom inner surface of the toner container 44 upon rotating agitators 43 and 44, almost all toner in the toner container 41 is transported to the toner supply roller 25K. It is desirable that rotary speed of the agitators 43 and 44 rotate as slow as possible so as not to apply stress to the toner.

Figure 3:
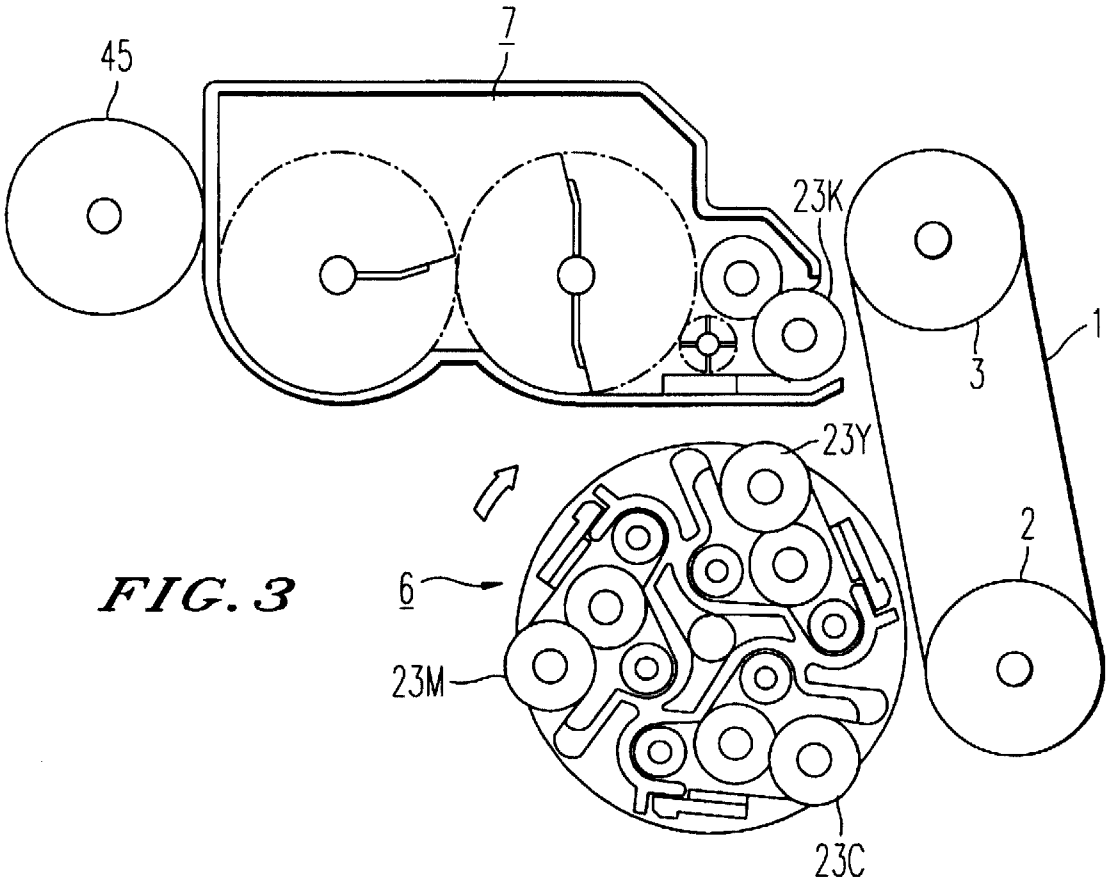
FIG. 3 is a front sectional view of developing devices showing the black developing device and a revolving type developing device in non-operating conditions.

FIG. 3 shows in a non-operating condition the black developing device 7 and the revolving type developing device 6. In FIG. 3, when the black developing device 7 is in the non-operating condition, the surface of the developing roller 23K is separated from the surface of the photoconductive belt 1. In this condition, the developing roller 23K is not rotated in order to prevent scatter and leakage of toner from the opening 41*a* of the black developing device 7. When the color developing device is in the non-operating condition, the casing of the revolving type developing device 6 faces the surface of the photoconductive belt 1 at a distance. In the present embodiment, the portion of the casing of the revolving type developing device 6 between the yellow developing roller 23Y and the cyan developing roller 23C always faces to the photoconductive belt 1 at a distance when the color developing device is in the non-operating condition.

According to the present embodiment, the yellow developing roller 23Y is operated first before the other developing rollers 23M and 23C during full color image formation and quickly faces the photoconductive belt 1.

When the black developing device 7 is in the operating condition, the black developing device 7 is shifted in position by means of a cam 45, and then the surface of the developing roller 23*k* is held in pressure contact with the surface of the photoconductive belt 1. When one of the color developing device is in the operating condition, the revolving type developing device 6 rotates until that one of the developing rollers faces the surface of the photoconductive belt 1.

Figure 4:
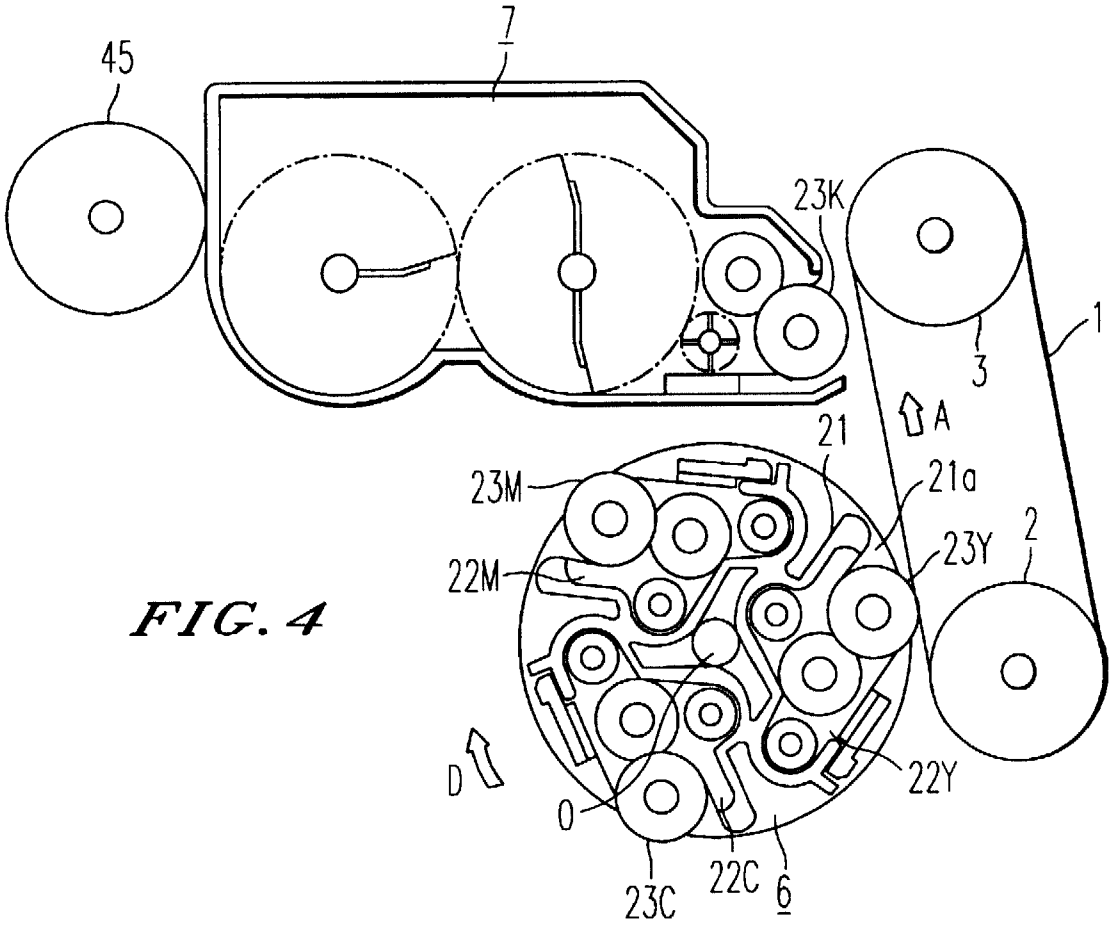
FIG. 4 is a front sectional view of the developing devices showing the black developing device in a non-operating condition and the revolving type developing device is in an operating condition.

FIG. 4 shows the yellow developing device 22Y in the operating condition. In FIG. 4, the revolving type developing device 6 includes the yellow developing device 22Y, a magenta developing device 22M and cyan developing device 22C. The developing devices 22Y, 22M and 22C have a yellow developing roller 23Y, a magenta developing roller 23M, a cyan developing roller 23C, respectively. A part of each developing roller 23Y, 23M and 23C is exposed from each opening 21. The yellow developing roller 23Y rotates in a direction indicated by an arrow E synchronized with a yellow image signal in order to develop an electrostatic image. At that time, the surface of the black developing device is separated from the surface of the photoconductive belt 1 by means of the cam 45 and a spring. Each of the developing devices 22Y, 22M and 22C stores a non-magnetic one component developer. The color developing device 6 rotates around a rotating axis 0 in order to position each of developing devices 22Y, 22M and 22C at the developing position.

Figure 5:
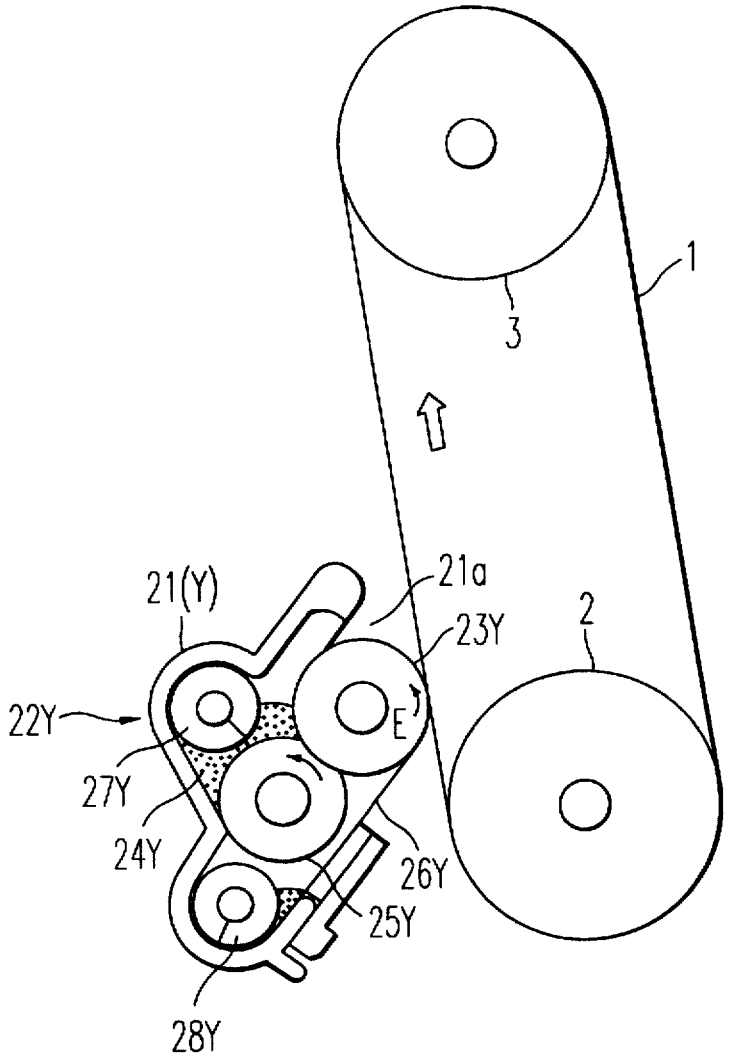
FIG. 5 is a front sectional view of yellow developing device of the revolving type developing device of the present invention.

FIG. 5 shows the yellow developing device 22Y extracted from the revolving type developing device shown in FIG. 4. Since each of the developing devices 22Y, 22M and 22C has the same structure and operates the same manner, only operation of the yellow developing device 22Y is explained.

In FIG. 5, when the yellow developing device 22Y is in the operating condition, the surface of the yellow developing roller 23Y is held in contact with the surface of the photoconductive belt 1 to make a nip between the surface of the yellow developing roller 23Y and the surface of the photoconductive belt 1. The yellow developing roller 23Y rotates in a direction indicated by an arrow E. A toner supplying roller 25Y, which is an elastic roller made of polyurethane foam, is provided below the yellow developing roller 23Y. The surface of the toner supplying roller 25Y is held in pressure contact with the surface of the yellow developing roller 23Y. The toner supplying roller 25Y rotates in the opposite direction to that of the yellow developing roller 23Y and at a different speed than the yellow developing roller 23Y. A free end of an elastic thin blade 26Y made of stainless steel is held in pressure contact with the surface of the yellow developing roller 23Y. A toner transport screw 27Y is also provided in the yellow developing device 22Y so as to transport toner from the top side to the bottom side, as shown in FIG. 5.

Figure 6:
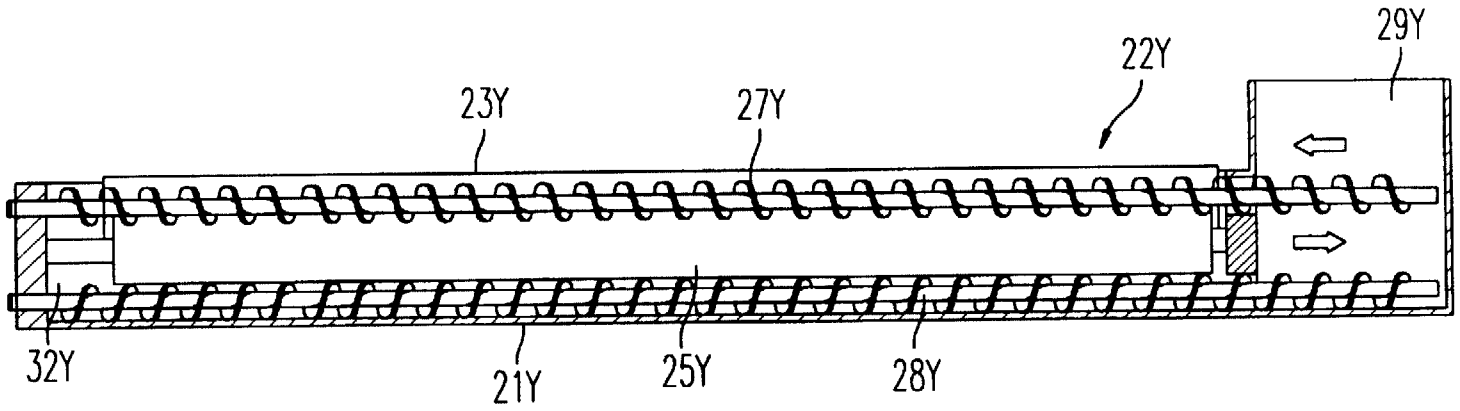
FIG. 6 is a transverse sectional view of the yellow developing device of the present invention.
Figure 7:
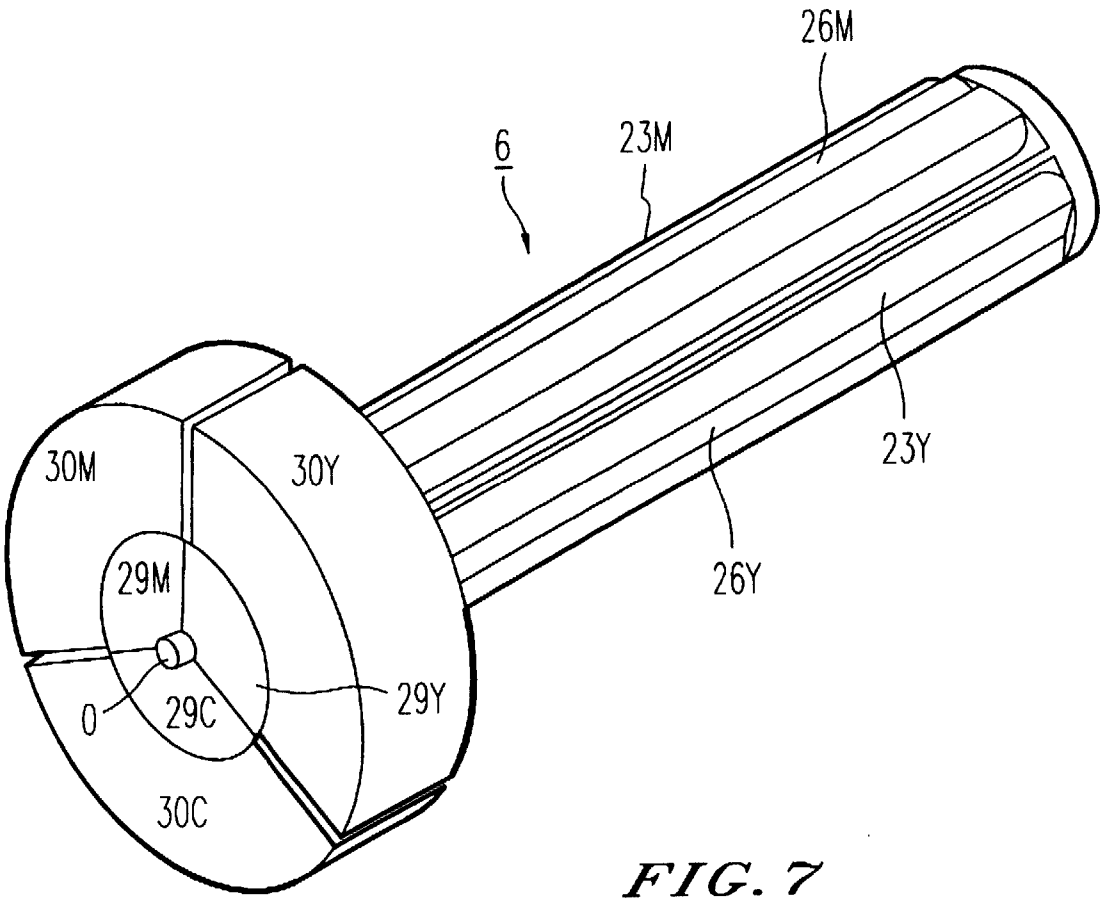
FIG. 7 is a perspective view of the revolving type developing device of the present invention.

FIG. 6 is a transverse sectional view of the yellow developing device 22Y, and FIG. 7 is a perspective view of the revolving type developing device 6. Referring to FIGS. 6 and 7, a toner container 29Y is provided at one end of the yellow developing device 22Y. The toner transport screw 27Y is positioned parallel to the developing roller 23Y between the both side plates of the developing device 22Y. The surface of the toner supplying roller 25Y is held in contact with a part of a casing 21Y so as to form toner transporting space 24Y by means of the developing roller 23Y, the toner supplying roller 25Y and the casing 21Y as shown in FIG. 5.

In FIG. 6, the toner transport screw 27Y rotates synchronized with the developing roller 23Y and the toner supplying roller 25Y so as to transport the toner from the toner container 29Y to the other side of the casing 21Y with respect to the longitudinal direction of the toner transport screw 27Y. By this operation, toner in the toner container 29Y is supplied to the toner transport space 24Y. By transporting toner by the toner transporting screw 27Y, toner in the toner transport space 24Y is supplied to the toner supplying roller 25Y, and then the toner on the toner supplying roller 25Y is charged at the nip between the surface of the toner supplying roller 25Y and the surface of the yellow developing roller 23Y and supplied to the surface of the yellow developing roller 23Y. The toner on the surface of the yellow developing roller 23Y is then passed through the nip between the surface of the yellow developing roller 23Y and the blade 26Y. The thin and uniform toner layer is formed on the yellow developing roller 23Y after passing through the nip. The toner on the yellow developing roller 23Y is developed on the surface of the photoconductive belt 1.

Toner on the yellow developing roller 23Y, which is not used in the developing process, is transported to toner circulating space 32Y which is provided outside of the yellow developing roller 23Y and the toner supplying roller 25Y with respect to the longitudinal direction of the both of rollers 23Y and 25Y. The toner which is transported to the toner circulating space by the toner transport screw 27Y is dropped to the bottom of the yellow developing device 22Y and then transported to the toner container 29Y by a toner transport screw 28Y which is disposed at the bottom of the yellow developing device 22Y.

Referring to FIG. 7, a yellow toner cartridge 30Y, a magenta toner cartridge 30M and a cyan toner cartridge 30C is each attached to a respective yellow toner container 29Y, a magenta toner container 29M and a cyan toner container 29C. Each of the toner cartridges 30Y, 30M and 30C is replaced when toner in each of the toner cartridges becomes empty.

Figure 8:
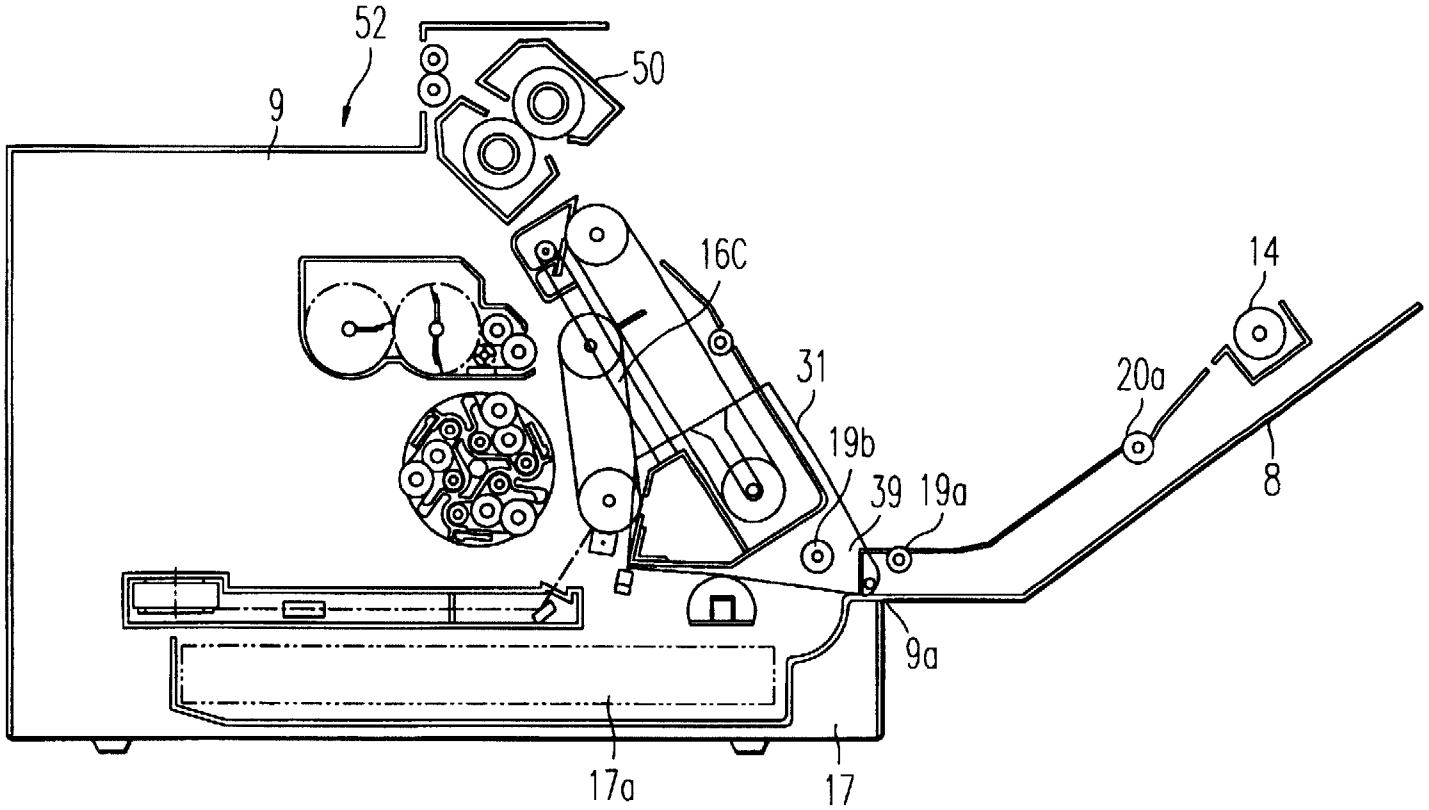
FIG. 8 is a view similar to FIG. 1, showing an opened front frame of the color image forming apparatus.

FIG. 8 shows the color printer in which a front frame 8 is opened. In FIG. 8, the body of the color printer includes the front frame 8 and a main frame 9. When the front frame 8 is opened, a paper transport path is exposed. The paper cassette 17 is disposed at the bottom of the main frame 9. The revolving type developing device 6, the black developing device 7 and the process cartridge 31 are provided in the main frame 9. Each of the revolving type developing device 6, the black developing device 7 and the process cartridge 31 can be replaced respectively when each device 6, 7 and 31 reaches the end of its useful life time. The fixing device 50 is also provided in the main frame 9 and the top of the main frame functions as a paper discharging tray 52.

The front frame 8 is rotatably supported at a rotating axis 9*a* provided on the main frame 9. The front frame 9 is usually closed as shown in FIG. 1. If a paper jam occurs in the paper transport path, the paper transport path can be exposed by opening the front frame 8 after unlocking the front frame 8. Since the paper feed roller 19*a*, the registration roller 20*a* and the transfer roller 14 are provided on the front frame 8, if the front frame 8 is opened, the paper transport path is completely exposed. Even if the front frame 8 is opened, the revolving type developing device 6, the black developing device 7 and the process cartridge 31 are stationary in the main frame. According to the present embodiment, a paper jam recovery operation becomes easy, and scatter of toner and leakage of toner during the paper jam recovery operation is prevented.

Figure 9:
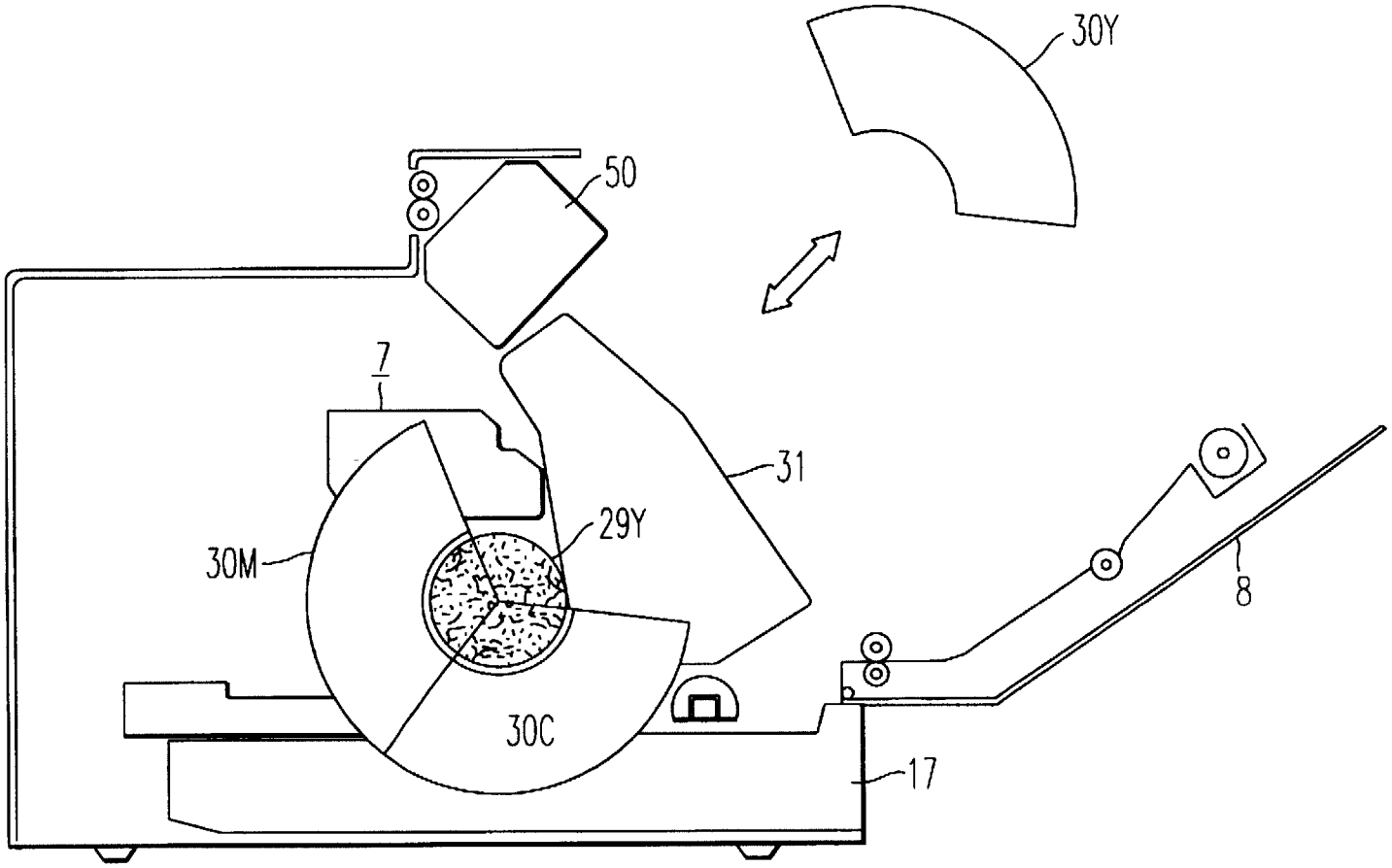
FIG. 9 is a view similar to FIG. 1, showing how a toner cartridge is replaced.

According to the present embodiment, if the color toner in any toner cartridge empties, that one of the empty toner cartridges 30Y, 30M and 30C can be individually replaced. FIG. 9 demonstrates how the yellow toner cartridge is replaced. When the quantity of the yellow toner in the yellow developing device 22Y is less than a predetermined quantity, a sensor outputs a toner empty signal, and toner replacing information is displayed on a control panel of the color printer. The yellow toner cartridge 30Y can be removed in a direction indicated by an arrow, and then a new yellow toner cartridge can be installed in a direction indicated by an arrow. The magenta toner cartridge 30M and the cyan toner cartridge 30C can be replaced at the same manner as the yellow toner cartridge. According to the present embodiment, each of the toner cartridges 30Y, 30M and 30C can be replaced without moving other process devices such as the revolving type developing device 6, the black developing device 7 and the process cartridge 31.

Figure 10:
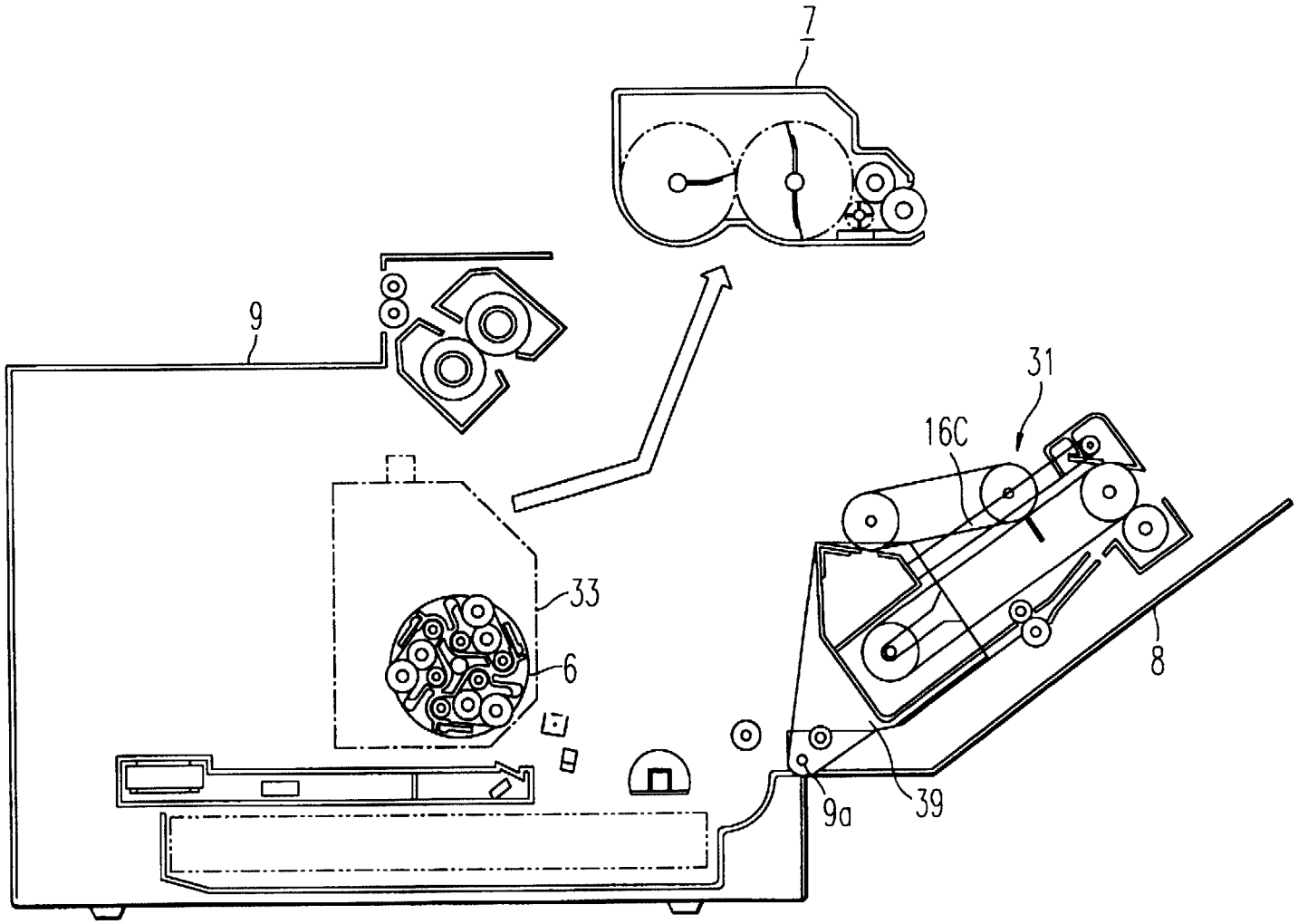
FIG. 10 is a view similar to FIG. 1, showing how the black developing device is replaced.

FIG. 10 demonstrates how the black developing device is replaced. The black developing device 7 is formed as a developer toner magazine (DTM) which is bodily replaced when the DTM reaches the end of its life time. For example, when a toner density sensor in the black developing device senses that the black toner in the black developing device is less than a predetermined quantity, a DTM replacement message is displayed on the operation panel of the color printer.

A sub-frame 39 which supports the process cartridge 31 is rotatably supported around the rotating axis 9*a*. In order to replace the black developing device, the sub-frame 39 is rotated around the rotating axis 9*a* with the front frame 8. The process cartridge 31 is also moved with the sub-frame 39 so as to lay bare the replacement opening for the black developing device 7. Then the black developing device 7 can be removed from a frame 33 through the opening without removing the process cartridge 31 from the sub-frame 39.

In the present embodiment, the black toner in the black developing device 7 empties when thousands of prints are made, while the color toner in the revolving developing device empties when ten thousands of prints are made. Therefore, the replacement period of time of the black developing device 7 is shorter than that of the revolving type developing device 6. When one of the color toners in the revolving type developing device empties, the revolving type developing device replacing message is displayed on the operation panel of the color printer. The revolving type developing device 6 can be removed from the main frame 9 with the black developing device 7. In order to replace the revolving type developing device, the sub-frame 39 rotates around the rotating axis 9*a* as shown in FIGS. 10 and 11.

Figure 11:
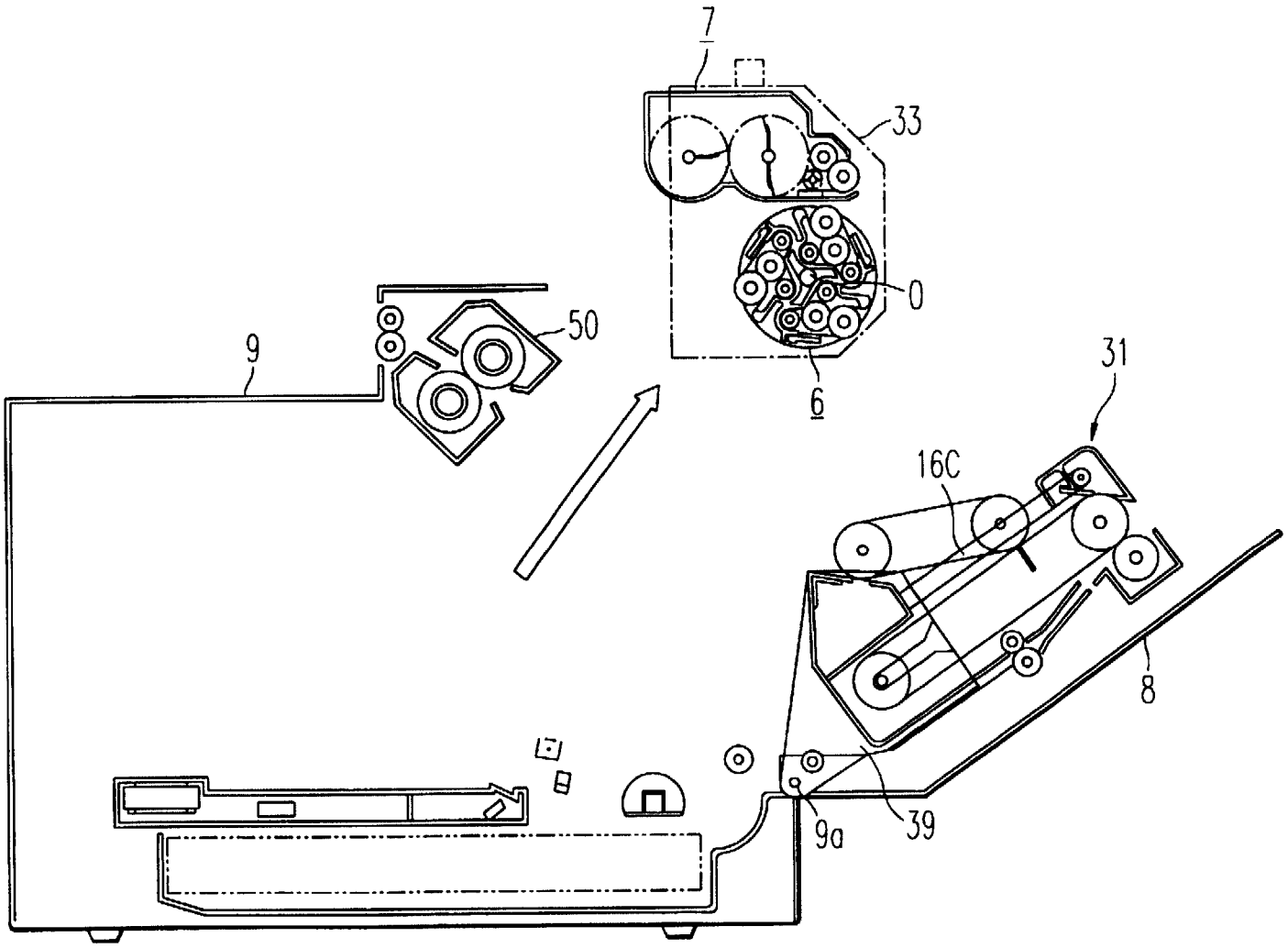
FIG. 11 is a view similar to FIG. 1, showing how the black developing device and the revolving type developing device are replaced.
Figure 12:
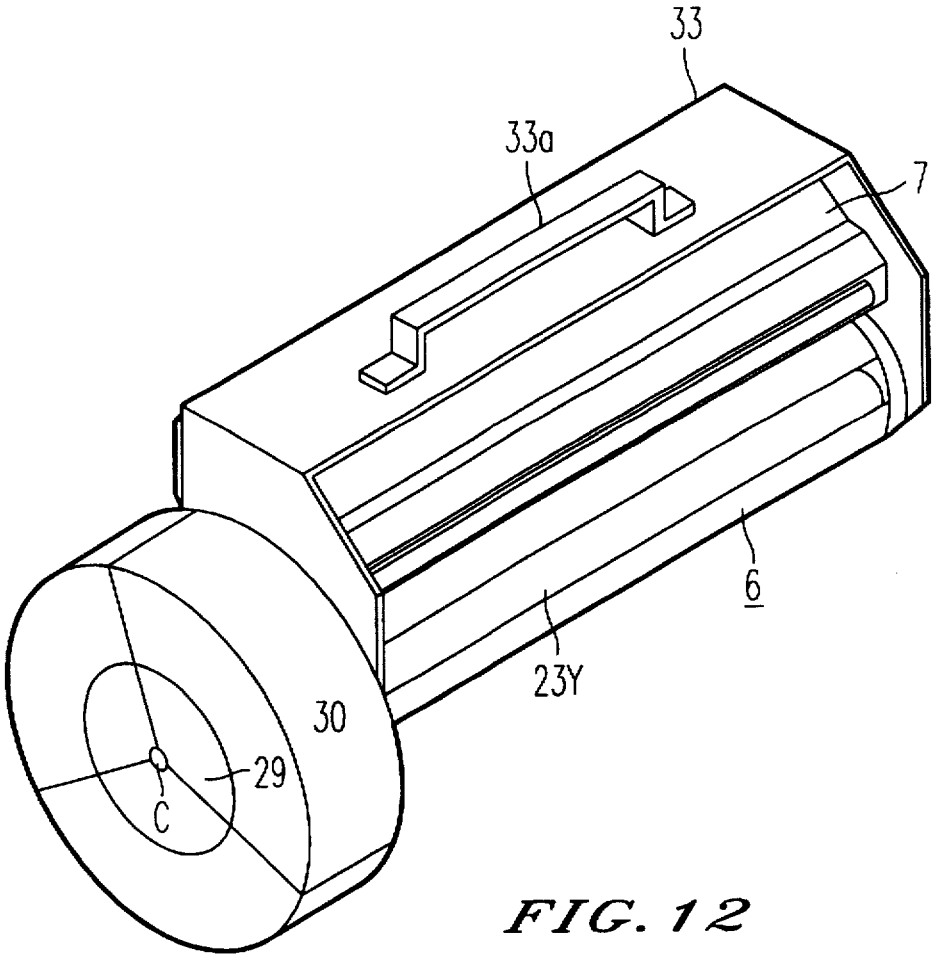
FIG. 12 is a perspective view of the developing devices showing the black developing device and the revolving type developing device installed in a frame.

Referring to FIGS. 11 and 12, the revolving type developing device 6 is rotatably supported on the frame 33. The black developing device 7 is also supported on the frame 33. The black developing device 6 can be removed from the frame 33. A handle 33*a* is provided on the frame 33. The revolving type developing device 6 and the black developing device 7 can be bodily replaced by removing and installing the frame 33.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A color image forming apparatus comprising:

a image bearing means for bearing an electrostatic latent image thereon;

a first developing unit which is separately replaceable, for developing the electrostatic latent image, wherein said first developing unit is a black developing device; a second developing unit for developing the electrostatic latent image, including means for supplying thereto toner from outside of said second developing unit, wherein said second developing unit is a revolving developing unit having a yellow developing device, a magenta developing device and a cyan developing device and not including said black developing device; and a removably mounted frame on which said first and second developing units are removably mounted.

2. An apparatus as claimed in claim 1, wherein said means for supplying said toner comprises:

a toner cartridge which is detachably provided on said second developing unit.

3. An apparatus as claimed in claim 1, wherein:

said second developing unit has a developing position on said image bearing means which is different from a developing position of said first developing unit on said image bearing means.

4. An apparatus as claimed in claim 1, wherein:

said first developing unit has a shorter life time than that of said second developing unit.

5. An image forming apparatus for forming a color image on a sheet of paper, comprising;

an image bearing member;

an replaceable black developing unit located adjacent said image bearing member; and a color revolving developing unit, wherein said revolving developing unit excludes said black developing unit, includes a yellow developing device, a magenta developing device and a cyan developing device, is located adjacent said image bearing member and has a developing position on said image bearing member different from that of said black developing unit, and a removably mounted frame on which said black and color developing units are removably mounted.

6. An apparatus as claimed in claim 5, wherein each of said yellow, magenta and cyan developing devices comprises a respective toner cartridge by which yellow toner, magenta toner and cyan toner is replenished.

7. An apparatus as claimed in claim 6, wherein:

the yellow toner cartridge, the magenta toner cartridge and the cyan toner cartridge are detachably provided on said yellow developing device, said magenta developing device and said cyan developing device, respectively.

8. An apparatus as claimed in claim 7, wherein said yellow developing device, said magenta developing device and said cyan developing device each comprise a toner transport device to transport toner from the respective toner cartridge located at one side of each said developing device to inside of each said developing device.

9. An apparatus as claimed in claim 6 wherein:

said toner cartridges are rotated together with said revolving developing unit.

10. An apparatus as claimed in claim 5, wherein:

said color revolving developing unit has a longer life time than that of said black developing unit.

11. An apparatus as claimed in claim 5 wherein:

said black developing unit is removable from said color image forming apparatus independently of said color revolving developing unit.

12. A method for developing an electrostatic latent image on a image bearing member of a color image forming device having a removable frame, comprising the steps of:

developing an electrostatic latent image on said image bearing member by an individually replaceable first black developing unit removably mounted to the frame;

developing other electrostatic latent images on said image bearing member by a second developing unit, wherein said second developing unit is a revolving developing unit removably mounted to the frame and having a yellow developing device, a magenta developing device and a cyan developing device, and not including said black developing device;

supplying toner from outside of said second developing unit to said second developing unit; and removing said first developing unit and said second developing device as a body from the color image forming device by removing the frame from the color image forming device.

13. A method according to claim 12, wherein said supplying step comprises:

supplying toner from a toner cartridge which is detachably provided on said second developing unit.

14. A method according to claim 12, further comprising the steps of:

removing said first developing unit from the color image forming device independently of removing of said second developing unit.

* * * * *